US007055594B1

(12) United States Patent
Springett et al.

(10) Patent No.: US 7,055,594 B1
(45) Date of Patent: Jun. 6, 2006

(54) PIPE GRIPPER AND TOP DRIVE SYSTEMS

(75) Inventors: Frank Benjamin Springett, Houston, TX (US); Eric T. Ensley, Houston, TX (US)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 10/999,815

(22) Filed: Nov. 30, 2004

(51) Int. Cl.
*E21B 19/16* (2006.01)

(52) U.S. Cl. ..... 166/85.1; 166/77.51; 166/379; 175/85

(58) Field of Classification Search .. 166/77.51–77.53, 166/85.1, 379; 175/52, 85
See application file for complete search history.

(56) References Cited

U.S. PATENT DOCUMENTS

| | | | | |
|---|---|---|---|---|
| 1,902,906 | A | | 3/1933 | Seamark |
| 2,192,805 | A | | 3/1940 | Seamark |
| 2,544,639 | A | | 3/1951 | Calhoun |
| 3,892,148 | A | | 7/1975 | Wiley |
| 3,965,987 | A | | 6/1976 | Biffle |
| 4,010,600 | A | | 3/1977 | Poole et al. |
| 4,023,449 | A | | 5/1977 | Boyadjieff |
| 4,115,911 | A | | 9/1978 | Poole et al. |
| 4,178,817 | A | | 12/1979 | Gibson |
| 4,205,423 | A | | 6/1980 | Poole et al. |
| 4,285,408 | A | | 8/1981 | Franks, Jr. |
| 4,346,629 | A | | 8/1982 | Kinzbach |
| 4,348,920 | A | | 9/1982 | Boyadjieff |
| 4,401,000 | A | | 8/1983 | Kinzbach |
| 4,415,193 | A | | 11/1983 | Carlberg |
| 4,421,179 | A | | 12/1983 | Boyadjieff |
| 4,449,596 | A | | 5/1984 | Boyadjieff |
| 4,458,768 | A | | 7/1984 | Boyadjieff |
| 4,529,045 | A | | 7/1985 | Boyadjieff et al. |
| 4,589,503 | A | | 5/1986 | Johnson et al. |
| 4,603,464 | A | | 8/1986 | Smith, Jr. et al. |
| 4,605,077 | A | | 8/1986 | Boyadjieff |
| 4,753,300 | A | | 6/1988 | Shaw et al. |
| 4,759,239 | A | | 7/1988 | Hamilton et al. |
| 4,793,422 | A | | 12/1988 | Krasnov |
| 4,800,968 | A | | 1/1989 | Shaw et al. |
| 4,813,493 | A | * | 3/1989 | Shaw et al. ..... 173/164 |
| 4,854,383 | A | | 8/1989 | Arnold et al. |
| 4,865,135 | A | | 9/1989 | Moses |
| 4,878,546 | A | | 11/1989 | Shaw et al. |
| 5,038,871 | A | | 8/1991 | Dinsdale |
| 5,044,232 | A | | 9/1991 | Schulze-Beckinghausen |
| 5,054,550 | A | | 10/1991 | Hodge |
| 5,107,940 | A | | 4/1992 | Berry |
| 5,255,751 | A | | 10/1993 | Stogner |

(Continued)

OTHER PUBLICATIONS

Iron Roughneck IR-3080. National Oilwell, 6 pp.. 2002.

(Continued)

*Primary Examiner*—David Bagnell
*Assistant Examiner*—G M Collins
(74) *Attorney, Agent, or Firm*—Guy McClung

(57) ABSTRACT

A top drive drilling system, in at least some aspects, having a top drive unit, and a pipe gripping system beneath the top drive unit which has an open throat for receiving a tubular to be gripped by the pipe gripping system; and, in at least certain aspects, the gripping system having a body with first and second jaws movably connected thereto and piston/cylinder devices movably interconnected with each jaw for moving the jaws to clamp and then to rotate the pipe.

10 Claims, 12 Drawing Sheets

U.S. PATENT DOCUMENTS

| | | | |
|---|---|---|---|
| 5,259,275 | A | 11/1993 | Schulze-Beckinghausen |
| 5,381,867 | A | 1/1995 | Berry |
| 5,388,651 | A | 2/1995 | Berry |
| 5,433,279 | A | 7/1995 | Tessari et al. |
| 5,501,286 | A | 3/1996 | Berry |
| 5,730,471 | A | 3/1998 | Schulze-Beckinghausen |
| 5,755,296 | A | 5/1998 | Richardson et al. |
| 5,992,801 | A | 11/1999 | Torres |
| 6,024,181 | A | 2/2000 | Richardson et al. |
| 6,227,587 | B1 | 5/2001 | Terral |
| 6,253,861 | B1 | 7/2001 | Carmichael |
| 6,276,450 | B1 | 8/2001 | Seneviratne |
| 6,279,662 | B1 | 8/2001 | Sonnier |
| 6,305,649 | B1 | 10/2001 | Walmsley et al. |
| 6,311,792 | B1 | 11/2001 | Scott et al. |
| 6,315,051 | B1 | 11/2001 | Ayling |
| 6,334,376 | B1 | 1/2002 | Torres |
| 6,431,029 | B1 | 8/2002 | Hawkins, III |
| 6,443,241 | B1 | 9/2002 | Juhasz et al. |
| 6,480,811 | B1 | 11/2002 | Denny et al. |
| 6,527,047 | B1 | 3/2003 | Pietras |
| 6,536,520 | B1 | 3/2003 | Snider et al. |
| 6,591,916 | B1 | 7/2003 | Ayling |
| 6,622,796 | B1 | 9/2003 | Pietras |
| 6,679,333 | B1 | 1/2004 | York et al. |
| 6,684,737 | B1 | 2/2004 | Schulze-Beckinghausen |
| 6,688,398 | B1 | 2/2004 | Pietras |
| 6,705,405 | B1 | 3/2004 | Pietras |
| 6,725,938 | B1 | 4/2004 | Pietras |
| 6,739,397 | B1 | 5/2004 | Ayling |
| 6,742,584 | B1 | 6/2004 | Appleton |
| 6,742,596 | B1 | 6/2004 | Haugen |
| 6,755,097 | B1 | 6/2004 | Bangert |
| 6,776,070 | B1 | 8/2004 | Mason et al. |
| 6,832,658 | B1 | 12/2004 | Keast |
| 2004/0159467 | A1 | 8/2004 | Ayling |

OTHER PUBLICATIONS

Automated Iron Roughnecks. Varco Systems. 6 pp.. 2001.
Continuous Circulation System CCS. maintains constant down-hole pressure during connections, Shaffer A Varco Company, 2 pp.. 2003.
Winning The Circulation War. von Flatern. Offshore Engineer. 6 pp., Nov. 1, 2003.

* cited by examiner

PIPE GRIPPER AND TOP DRIVE SYSTEMS

BACKGROUND OF THE INVENTION

1. Field of the Invention

This present invention is directed to top drive drilling systems, joint breaker/making apparatus for use with such systems; and methods of their use.

2. Description of Related Art

In several prior art drilling systems, a continuous fluid circulation system is used so that tubulars added to a string, e.g. but not limited to drill pipe added to a drill string, are added without terminating the circulation of fluid through the string and in the wellbore. Typical continuous circulation systems permit the making or breaking of a threaded connection between two tubulars, e.g. a saver-sub-drill-pipe connection in a top drive drilling system, within an enclosed chamber. The saver-sub-drill-pipe connection is broken with part of the saver sub located within a pressure chamber of the continuous circulation system so that drilling fluid is continuously circulated through the string and wellbore. Certain prior art wellbore drilling operations involve the addition of drill pipes to a drill string that extends down into a wellbore and which is rotated and urged downwardly to drill the wellbore. Typically drilling fluid is circulated through the drill string and back up an annular region formed by the drill string and the surrounding formation to lubricate and cool the bit, and to remove cuttings and debris from the wellbore. In one prior art method a kelly bar, connected to a top joint of the drill string, is used to rotate the drill string. A rotary table at the derrick floor level rotates the kelly bar while simultaneously the kelly bar can move vertically through a drive bushing within the rotary table at the rig floor. In another prior art method, top drive drilling unit suspended in a derrick grips and rotates the drill string and a kelly bar is not used.

As more pieces of hollow tubular drill pipe are added to the top of a drill string, drilling is halted and successive pieces of drill pipe are connected to the drill string. To remove drill pipe from the string, to "trip out" of a hole, (e.g. to replace a drill bit or to cement a section of casing), the process is reversed, again requiring cessation of drilling operations which can entail stopping circulation of drilling fluid until operations re-commence. Re-instituting the flow of drilling fluid and reconstituting the required column of it in the wellbore can take a significant amount of time and the effects of removing and then reintroducing the drilling fluid into the wellbore can have harmful effects on both equipment and on the wellbore and to the formation being drilled through. In such circumstances, expensive and time-consuming of additional fluid weighting may be required It is often preferable to maintain drilled cuttings in suspension in the drilling fluid to facilitate moving them away from a drill bit and to prevent them from falling back down in a wellbore. Cessation of fluid circulation can cause the drilled cuttings to sink. To counter this in many prior art systems additional fluid weighting is attempted, often increasing the viscosity of the fluid. This results in the need for more pumping power at the surface to move the thicker fluid; but such an increase in pump force can result in over pressuring of a downhole which can cause formation damage or loss of fluids downhole.

Certain prior art continuous circulation systems are proposed in U.S. Pat. No. 6,412,554 which attempt continuous fluid circulation during the drilling operation, but in these systems rotation of the drill string is stopped and re-started in order to make and break tubular connections. This involves significant loss of drilling time. Also, starting rotation of the drill string can result in damaging over torque portions of the drill string.

U.S. Pat. No. 6,315,051 discloses continuous drilling/circulation systems and methods; but with these systems drilling is halted during tubular connection procedures.

U.S. Published patent application No. 0030221519 published Dec. 4, 2003 (U.S. Ser. No. 382,080, filed: Mar. 5, 2003) discloses an apparatus that permits sections of tubulars to be connected to or disconnected from a string of pipe during a drilling operation. The apparatus further permits the sections of drill pipe to be rotated and to be axially translated during the connection or disconnection process. The apparatus further allows for the continuous circulation of fluid to and through the tubular string during the makeup or breakout process. The apparatus defines a rig assembly comprising a top drive mechanism, a rotary drive mechanism, and a fluid circulating device. Rotation and axial movement of the tubular string is alternately provided by the top drive and the rotary drive. Additionally, continuous fluid flow into the tubular string is provided through the circulation device and alternately through the tubular section once a connection is made between an upper tubular connected to the top drive mechanism and the tubular string. This application also discloses a method for connecting an upper tubular to a top tubular of a tubular string while continuously drilling, the method including steps of: operating a rotary drive to provide rotational and axial movement of the tubular string in the wellbore; positioning the upper tubular above the top tubular of the tubular string, the upper tubular configured to have a bottom threaded end that connects to a top threaded end of the top tubular; changing a relative speed between the upper tubular and the top tubular to threadedly mate the bottom threaded end of the upper tubular and the top threaded end of the top tubular such that the upper tubular becomes a part of the tubular string; releasing the tubular string from engagement with the rotary drive; and operating a top drive to provide rotational and axial movement of the tubular string in the wellbore.

In some prior art systems in which a top drive system is used for drilling, a stand of drill pipe (e.g. a 90 foot stand with three interconnected pieces of drill pipe) is threadedly connected to and below a saver sub. Once drilling has proceeded down to the extent of the length of a stand, the saver sub is located within a pressure chamber of a continuous fluid circulation system. In order to add a new stand with this type of prior art system, the connection with the saver sub is broken by the continuous fluid circulation system. The top drive drilling unit is raised and, along with it, the saver sub is raised and exits from the top of the continuous circulation system. In order, then, to connect a new stand of drill pipe, the top drive drilling unit's elevator is moved away from the drill string's center line. An elevator is associated with the top drive drilling unit, but typically this elevator is not used to receive and support the new stand because is cannot stab the saver sub into the stand and release it and, often, the saver sub is so long that longer support links would be needed. Also, in many cases, as a top drive drilling unit is raised, it is desirable to backream the wellbore as the top drive drilling unit is raised. In a backreaming operation the rotation of the drill string is not reversed. If a top drive drilling unit is used, it is not possible to determine or control which two pieces of drill pipe in the drill string will be disconnected, but, in adding a new stand, it is the saver-sub-drill-pipe connection which must be broken.

SUMMARY OF THE PRESENT INVENTION

The present invention, in at least certain embodiments, teaches a new top drive drilling system with a top drive drilling unit and a joint breaking system suspended below the top drive drilling unit.

In certain aspects a top drive drilling system according to the present invention includes a joint handling system which, in one aspect, is a joint breaker system that is a pipe gripper system according to the present invention which has a body with an open throat for receiving a tubular member and two selectively engageable jaws for contacting and gripping a tubular that has been positioned within the throat (in one aspect, a piece of drill pipe which, in one aspect, may be part of a stand of drill pipe). In one aspect each jaw has an interconnected hydraulic cylinder apparatus which is selectively controlled and activated to move the jaw into gripping engagement with a tubular or to move it out of gripping engagement with a tubular so that the tubular can be moved out of the throat and away from the pipe gripper system. In another aspect, e.g. by inverting the system as it is used for joint breaking, the system can be used, according to the present invention, to make connections (with appropriate re-configuration of hydraulic fluid lines).

In certain aspects such a gripper system is used not to spin a tubular (as may be a tong), but to grip a tubular and rotate sufficiently to break its threaded connection to another corresponding tubular. In one aspect hydraulic cylinder apparatuses which are used to effect gripping of a tubular are also used to effect slight rotation of the tubular sufficient to break its threaded connection with another tubular.

In one aspect a support for a pipe gripper system according to the present invention (useful with grippers according to the present invention and with prior art grippers) has eye members connected to corresponding main links which are connected to a top drive drilling unit. Each eye member has a body with a channel therethrough and a support shaft extends through each channel. A pipe gripper body with the open throat is connected to lower ends of these support shafts. Optionally, a holding mechanism is connected to the upper ends of these shafts. This holding mechanism has two upper latches, each with an open throat, which encompass a part of the main links that connect at the pipe gripper system to the top drive drilling unit. These latches are selectively operable so that in a first mode while drilling (and while tripping or backreaming), the pipe gripper system [and, if present, an elevator connected therebelow] hang below the top drive drilling unit; and, in a second mode, the upper latches pivot so that the previously-encompassed portions of the main links exit from the upper latches freeing the support shafts thereby permitting the pipe gripper system (and equipment connected therebelow, if any; e.g., but not limited to an elevator) to be moved away from a center line coinciding with a center line of the wellbore. Thus, in one particular aspect, an elevator suspended below the pipe gripper system can be presented to rig personnel, e.g., but not limited to a derrickman for emplacement around a piece of drill pipe, e.g., but not limited to, a piece of drill pipe in a stand of drill pipe.

Such a system can be used advantageously with a continuous circulation system. The pipe gripper, with the upper latches engaging or disengaging the main links, is moved away from the wellbore center line and out of the way of the continuous circulation system so that the top drive drilling unit can continue to rotate a drill string, permitting the top drive drilling unit to move down further than it would be able to if the pipe gripper system (and, if connected thereto, an elevator, etc.) was still in the way beneath the continuous circulation system.

In certain aspects, using an elevator (e.g. as disclosed in the co-pending co-owned application entitled "Methods And Apparatuses For Wellbore Operations" filed on even date with the present invention, U.S. Provisional Application No. 60/631,954), the elevator has dual opposed members which have dual interactive connection apparatuses so that either side of the elevator can be opened. Thus, the elevator can be opened on one side to permit the elevator unit to be moved away from the wellbore center line so that the top drive drilling unit can drill the drill string down as far as possible before adding a new piece or stand of drill pipe; and then the elevator can be opened from the other side for receiving a new piece or stand of drill pipe. In certain aspects, such an elevator has dual opposed selectively releasable latch mechanisms and dual opposed handling projections.

It is, therefore, an object of at least certain preferred embodiments of the present invention to provide new, useful, unique, efficient, nonobvious top drive drilling systems, components thereof, joint making/breaking apparatuses, and methods of their use;

Such systems and methods in which in a pipe gripper system the same piston/cylinder devices are used in torquing a tubular as are used in clamping a tubular;

Such systems and methods which employ an open throat pipe gripper system suspended below a top drive drilling unit; and Such systems and methods with apparatus for selectively locating the pipe gripper system operably beneath the top drive drilling unit and for selectively moving the pipe gripper system away from such a position for further tubular rotation by the top drive drilling unit without the need for disconnecting the pipe gripper system from its connection to the top drive drilling unit.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later disguise it by variations in form, changes, or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1A:
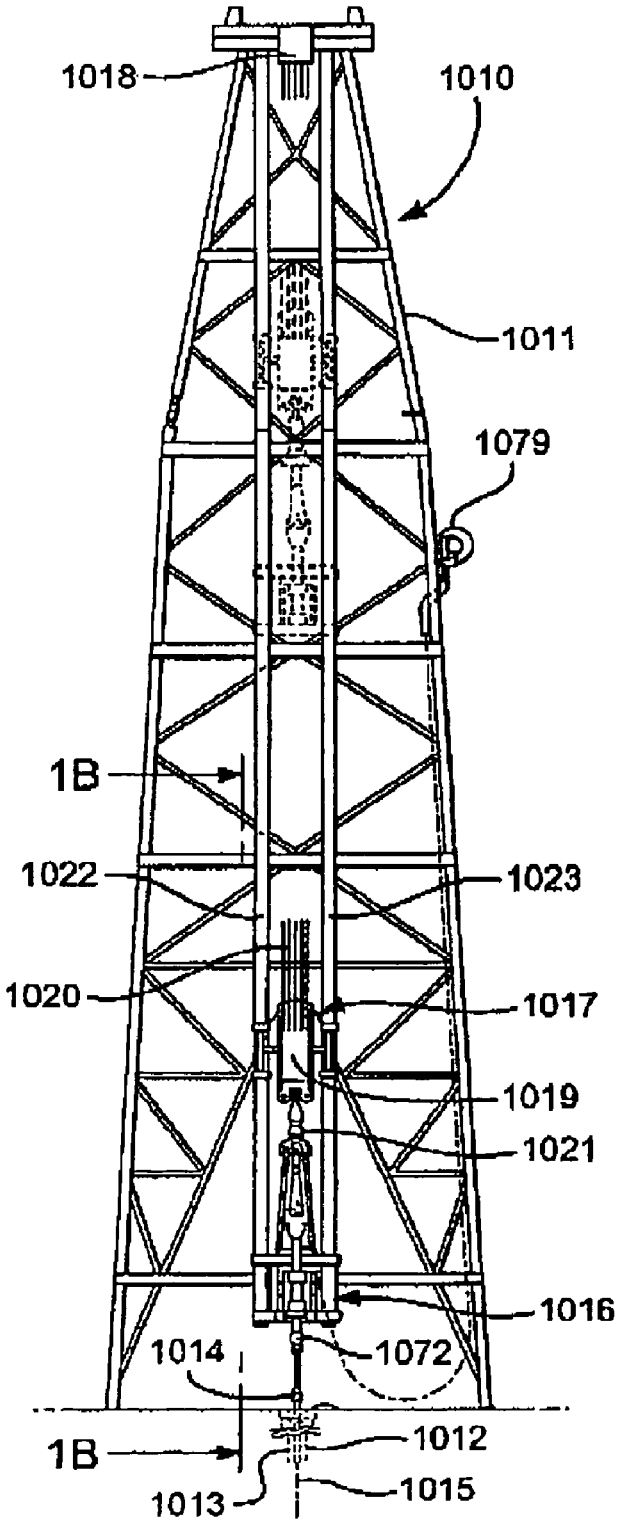
Fig.1A Prior Art
FIG. 1A is a front elevation view of a prior art well drilling apparatus.
Figure 1B:
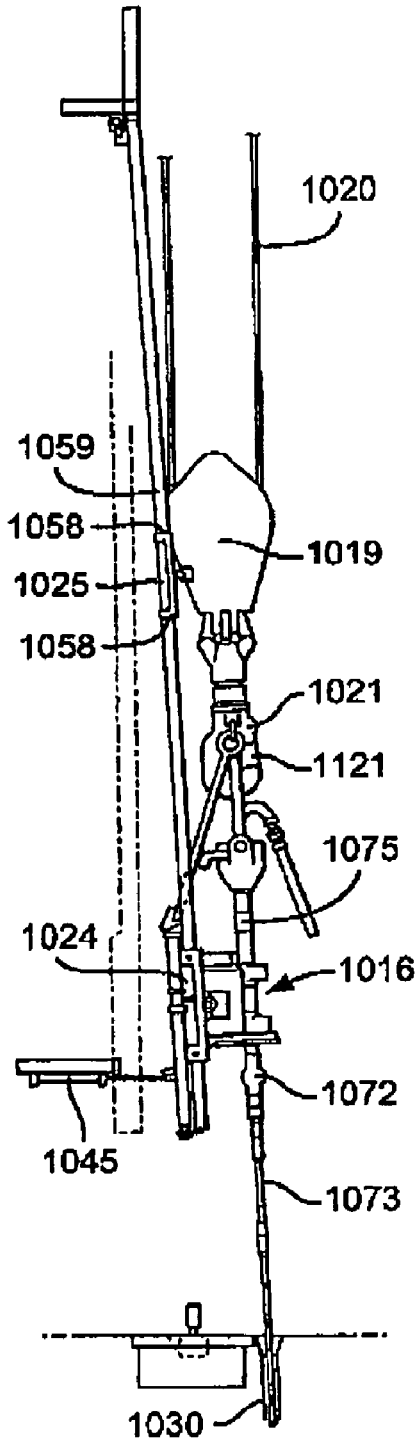
Fig.1B Prior Art
FIG. 1B is a side elevational view taken on line 1B—1B of FIG. 1A but showing the drilling unit swung to its mouse-hole position.
Figure 1C:
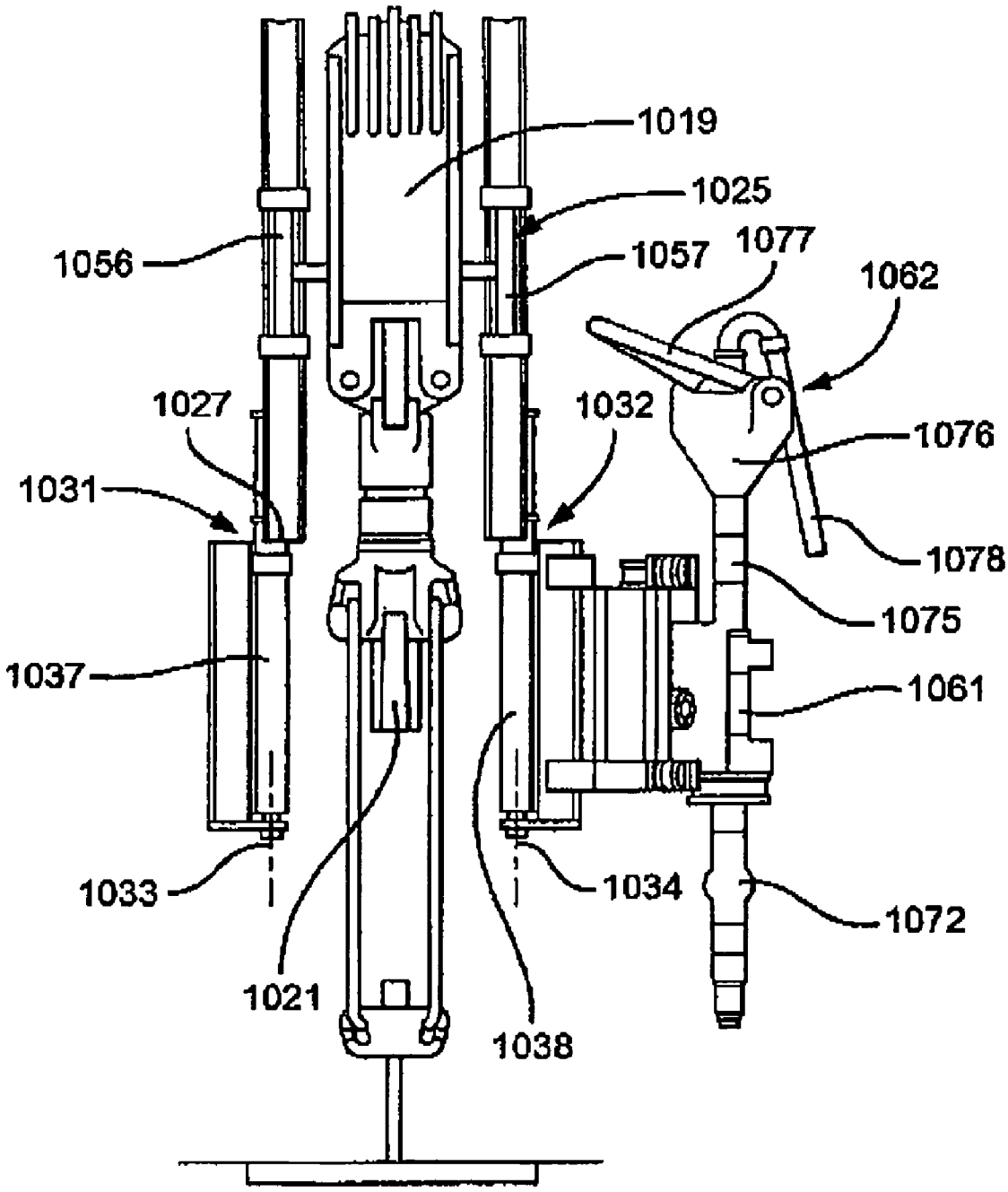
FIG. 1C is a fragmentary front elevational view showing the drilling unit of FIG. 1A swung to its retracted position permitting a trip of the well pipe into or out of the well.

FIGS. 1A–1C show a prior art rig and top drive system 1010 as disclosed in U.S. Pat. No. 4,458,768 (incorporated fully herein for all purposes).

The prior art drilling rig 1010 illustrated in FIGS. 1A–1C includes a derrick 1011 projecting upwardly above a location at which a well bore 1012 is being drilled by a rotary drill string 1013 formed in conventional manner in a series of drill pipe stands connected together in end-to-end fashion at threaded connections 1014. The string 1013 is turned about the vertical axis 1015 of the well by a drilling unit 1016 connected to the upper end of the string. The drill string and unit 1016 are supported and adapted to be moved upwardly and downwardly by a hoisting mechanism 1017 including a crown block 1018, traveling block 1019, tackle 1020, supporting block 1019 from block 1018, and power driven draw works for reeling the line 1020 in or out to raise or lower the traveling block. The traveling block supports a hook 1021 from which the drilling unit is suspended, and which has a gate 1121 adapted to be opened for connecting and disconnecting the drilling unit. The drilling unit 1016 and hook 1019 are guided during their upward and downward movement by two sectionally formed parallel elongated guide rails 1022 and 1023, engaging and guiding a carriage 1024 forming a portion of the drilling unit and a carriage 1025 to which the traveling block is connected.

The two sectionally formed guide rails 1022 and 1023 are preferably of H-shaped horizontal sectional configuration that continues from the upper extremity of each rail to its lower extremity. The rails 1022 and 1023 have upper sections which extend from the upper end of derrick 1011 to a mid-derrick location and are attached rigidly to the derrick for retention stationarily in positions of extension directly vertically and parallel to one another and to well axis 1015. Beneath the mid-derrick location the two guide rails have second portions or sections extending parallel to one another, continuing downwardly and to locations 1027, and mounted by two pivotal connections for swinging movement relative to upper sections and about a horizontal axis. An inclined mousehole 1030 is used (FIG. 1B).

The rails have third lowermost sections which are carried by the second sections for swinging movement therewith between the vertical and inclined positions and which also are mounted by connections 1031 and 1032 for horizontal swinging movement about two axes 1033 and 1034 which are parallel to one another and to the longitudinal axes of the second sections.

The two pivotal connections 1031 and 1032 include two parallel mounting pipes or tubes 1037 and 1038 connected rigidly to the second sections. The two second rail sections are adapted to be power actuated between the vertical and inclined positions by a piston and cylinder mechanism 1045 whose cylinder is connected to a horizontally extending stationary portion of the derrick, and whose piston rod acts against the tube 1037 of pivotal connection 1031.

Carriage 1025 to which traveling block 1019 is connected includes two frames 1056 and 1057 extending partially about the rails 1022 and 1023 respectively and rotatably carrying rollers 1058 which are received between and engage the front and rear flanges 1059 of the various rail sections in a manner effectively locating carriage 1025 against movement transversely of the longitudinal axis of the rail structure, and guiding the carriage for movement only longitudinally of the rails.

The drilling unit 1016 includes the previously mentioned rail contacting carriage structure 1024, a power unit 1061 for turning the string, and a conventional swivel 1062 for delivering drilling fluid to the string.

The power unit 1061 of the drilling assembly includes a pipe section having a lower tapered external thread forming a pin and threadedly connectable to the upper end of drill string 1013 to drive it. In most instances, a conventional crossover sub 1072 and a short "pup joint" 1073 are connected into the string directly beneath the power unit. At its upper end, pipe section 1070 has a tapered internal thread connectable to the rotary stem 1075 of swivel 1062. This stem 1075 turns with the drill string relative to the body 1076 of the swivel, which body is supported in non-rotating relation by a bail 1077 engaging hook 1021 of the traveling block. Drilling fluid is supplied to the swivel through a flexible inlet hose 1078, whose second end is connected to the derrick at an elevated location 1079 well above the level of the rig floor. For driving the tubular shaft 1070, power unit 1061 includes an electric motor.

Figure 2:
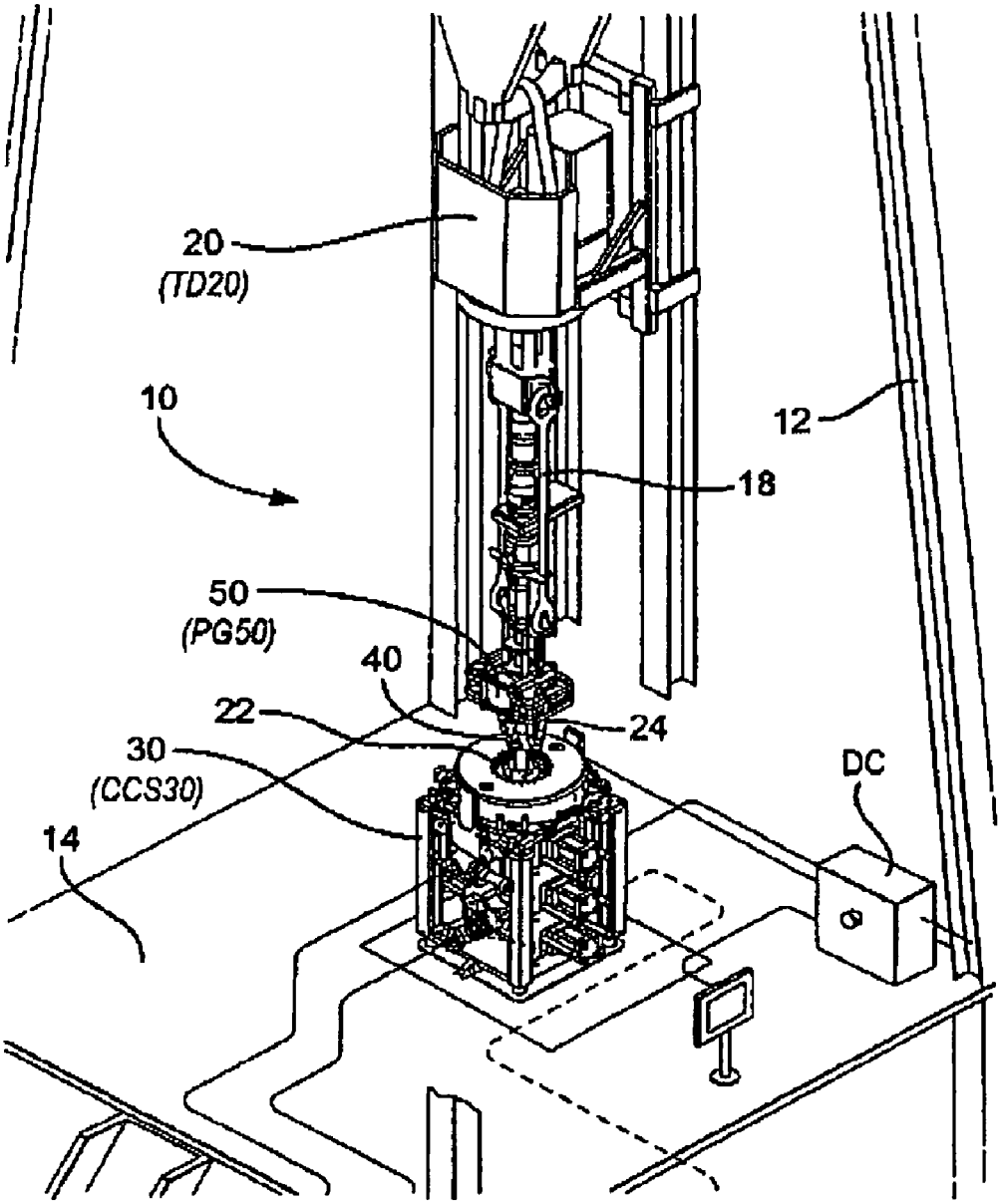
FIG. 2 is a perspective view of a top drive system with a pipe gripper according to the present invention.

FIG. 2 shows a top drive drilling system 10 according to the present invention which includes a top drive drilling unit 20 ("TD 20") suspended in a derrick 12 (like the rig and derrick in FIG. 1A with the various parts etc. as shown in FIG. 1A). A continuous circulation system 30 ("CCS 30")

rests on a rig floor 14 and part of a saver sub 22 projects up from the CCS 30. The saver sub 22 is connected to and rotated by the TD 20.

The CCS 30 is any known continuous circulation system and is, in one aspect, a CCS system commercially available from Varco International, Inc.

An elevator 40 according to the present invention is suspended below the TD 20. Optionally, a pipe gripper 50 ("PG 50") is suspended from the TD 20 and the elevator 40 is suspended from the PG 50. Any suitable known elevator may be used with the pipe gripper 50 or, alternatively, an elevator may be used as disclosed in the co-pending and co-owned U.S. patent application entitled "Methods And Apparatuses For Drilling Wellbores" filed on even date with the application for this patent. The PG 50 is suspended from the TD 20 with links 18 and the elevator 40 is suspended from the PG 50 with links 24.

Figure 2A:
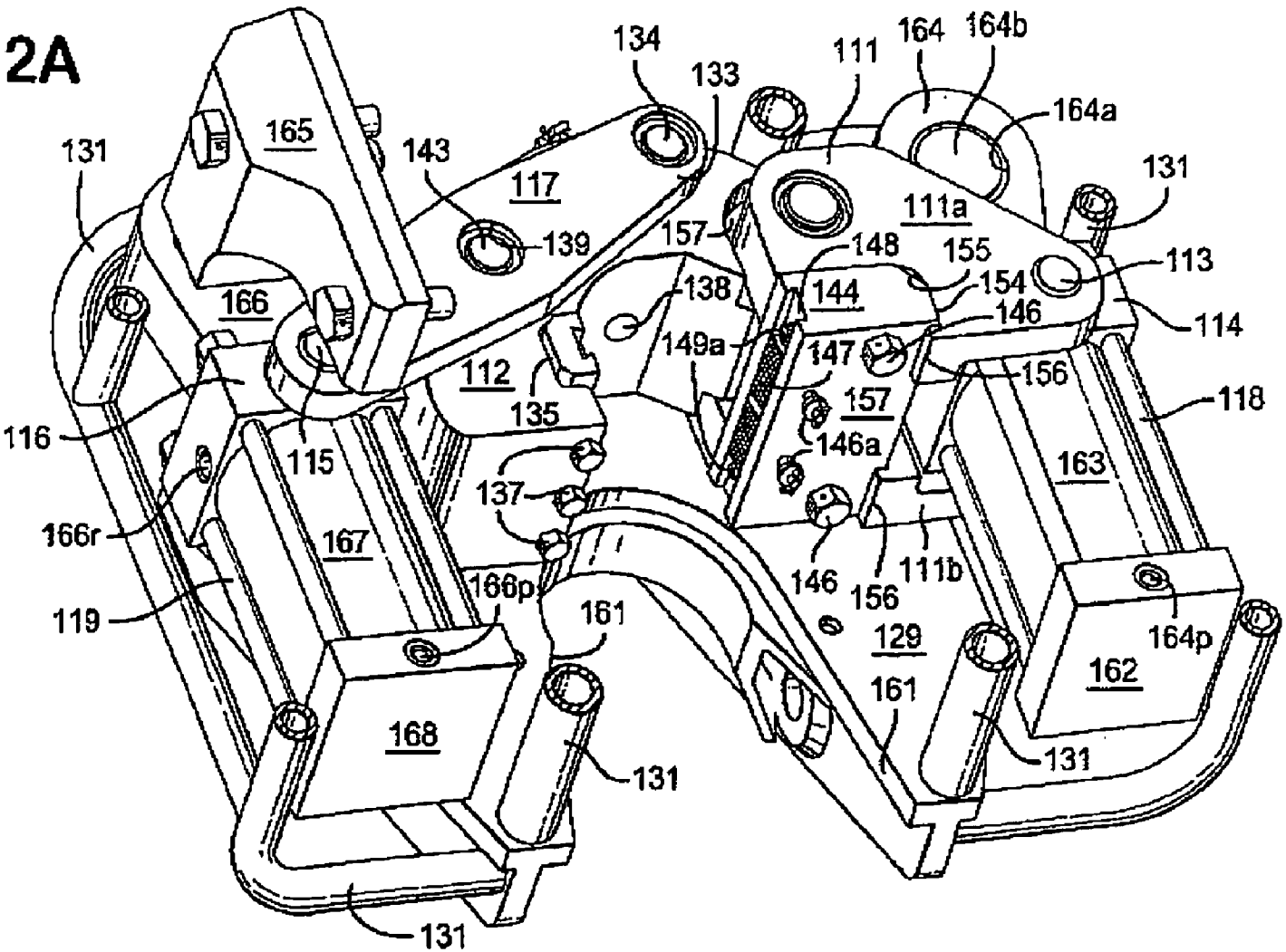
FIGS. 2A and 2B are perspective views of a gripper according to the present invention which can be used in the system of FIG. 2.
Figure 2B:
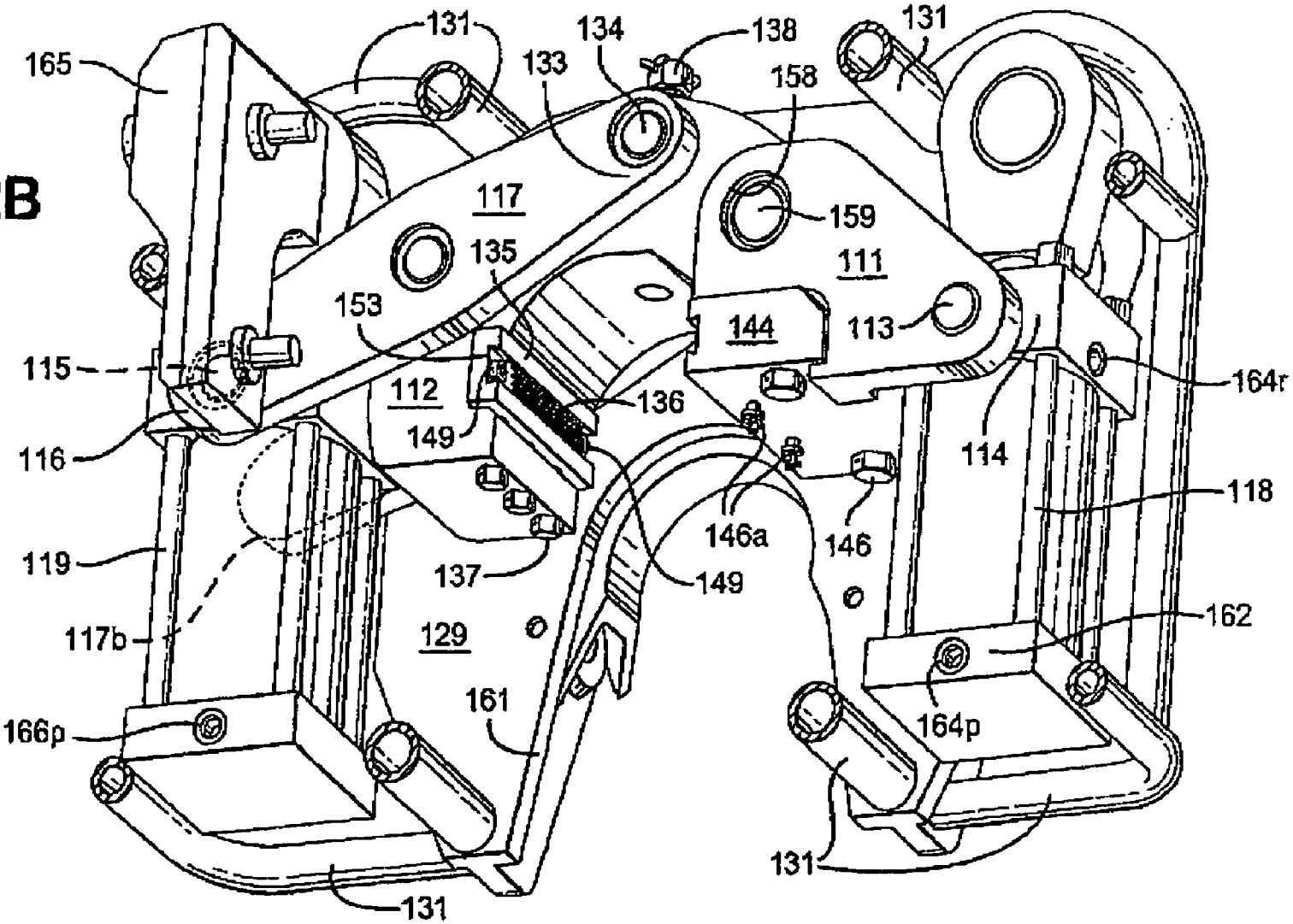

As shown in FIGS. 2A and 2B, a pipe gripping system 110 according to the present invention has a body 129 and two movable jaws 111, 112. The jaw 111 is pivotably connected with a pin 113 to a movable member 114 and the jaw 112 is pivotably connected with a pin 115 to a movable member 116 via a connecting bar 117. The movable member 114 is connected to four shafts 118 and the movable member 116 is connected to four shafts 119. An end 133 of the connection bar 117 is secured with a pin 134 to the jaw 112. A gripping insert apparatus 135 with a removable insert 136 is releasably held on the jaw 112 by removable bolts 137. Studs 149 insure proper placement of the removable insert 136 in a groove 153 of a holder 135. A shoulder screw 138 (see, e.g. FIG. 9A) extends through the jaw 112. The connection bar 117 has a hole 139 which receives a pin 143 which passes through the jaw 112. The connection bar 117 shown in FIG. 2A is a top connection bar and a similar lower connection bar 117*b* (see FIG. 9A; shown in outline in FIG. 2B) is connected to the jaw 112 by the same pins 115, 134, 143.

The jaw 111 has a gripping insert apparatus 144 releasably secured to the jaw 111. Bolts 146*a* releasably secure the gripping insert apparatus 144 to the insert holder body 157. An insert 147 is held within a groove 148 by studs 149*a*. Bolts 146 secure the insert holder body 157 to the jaw 111. An end 154 of the insert holder body 157 is held in a recess 155 defined by part of the jaw 111 and by lips 156.

A hole 158 in the jaw 111 receives a pin 159 that projects through the jaw 111 and permits pivotal movement of the jaw 111 with respect to the jaw 112. The jaw 111 includes top and bottom parts 111*a*, 111*b* respectively.

The body 129 has an open throat 161 for receiving a portion of a tubular, e.g., but not limited to, a tubular, a drill pipe, a saver sub, or a splined portion of a saver sub used with a top drive drilling system.

The movable member 114 is connected to a base member 162 by the shafts 118. The movable member 116 is connected to a base 168 by the shafts 119.

Trunnion blocks 165 are connected to a parts of piston/rod assemblies as described below. Bolts 165*a* and 165*b* connect the trunnion blocks 165 to a splined torque plate 165*d* (see FIG. 10). The movable member 116 is secured to a connector 166 (part of a piston/rod assembly) which has a hole 166*a* through which extends a pin 166*b* which is integral with the trunnion block 165 above it. Similarly, the movable member 114 is secured to a connector 164 (part of a piston/rod assembly) which has a hole 164*a* through which extends a pin 164*b* which is integral with the trunnion block 165*a* (see FIG. 10). A framework 131 (solid or tubular) encompasses the body 129.

Figure 3A:
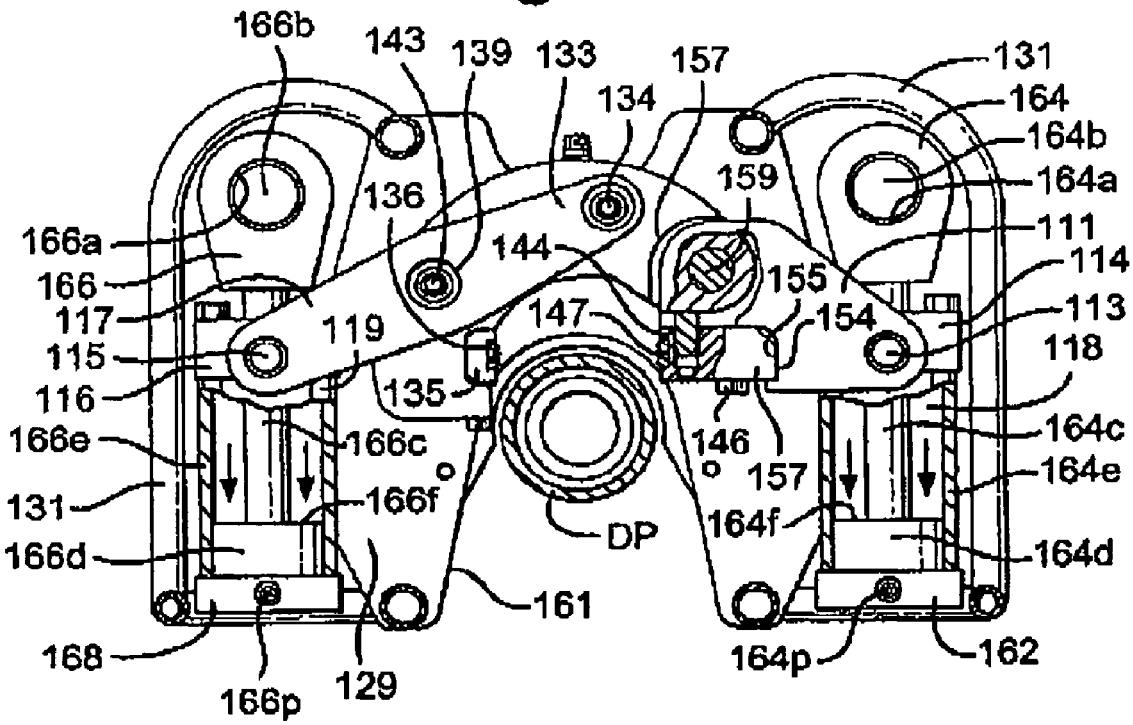
FIG. 3A is a top view of part of the mechanism of the pipe gripper shown in FIG. 2.
Figure 3B:
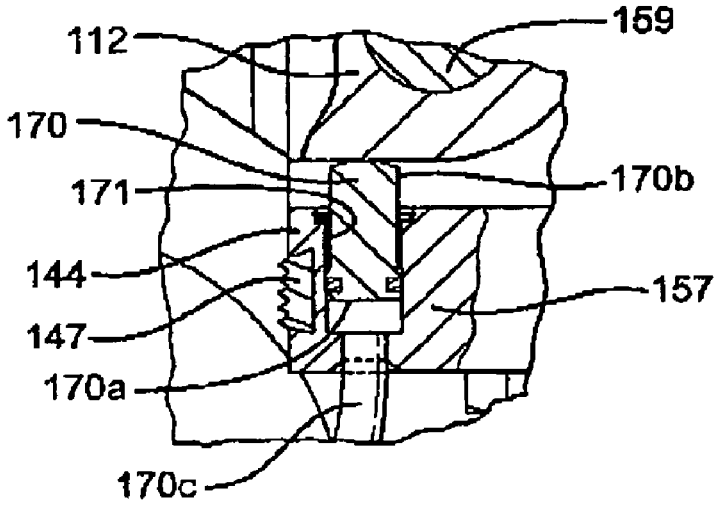
FIG. 3B is an enlargement in cross-section of part of the mechanism of FIG. 3A.

FIG. 3B shows in detail a selectively activatable piston 170 with one end 170*a* sealingly disposed within a recess 171 in the insert holder body 157 and another end 170*b* projecting out from the recess 171 to contact the jaw 112. Hydraulic fluid under pressure in a hose 170*c* is applied to the end 170*a* of the piston 170 to initially maintain the jaws 111, 112 in the position shown in FIGS. 3A and 4. This hydraulic fluid under pressure can be supplied from a separate source; from existing hydraulic lines, e.g. lines to a top drive; and/or from a manifold interposed between an hydraulic power source and the gripper system 110.

The piston/rod assembly with the connector 166 has a shaft 166*c* to which is connected a piston 166*d* which is movable within a housing 166*e* in response to hydraulic fluid under pressure (from any of the sources for the hydraulic power that moves the piston 170) introduced into the housing 166*e*. As shown in the "stored" position of FIG. 3A, pressure is applied to a surface 166*f* of the end 166*d* to maintain the jaw 112 in the position shown.

The piston/rod assembly with the connector 164 has a shaft 164*c* to which is connected a piston 164*d* which is movable within a housing 164*e* in response to hydraulic fluid under pressure introduced into the housing 164*e*. The housing 166*e* has hydraulic power fluid channels 166*p* and 166*r* for introducing/venting hydraulic power fluid from either side of the piston 166*d*. The housing 164*e* has hydraulic power fluid channels 164*p* and 164*r* for introducing/venting hydraulic power fluid from either side of the piston 164*d*. As shown in FIG. 3A in the "stored" position, pressure is applied to a surface 164*f* of the piston 164*d* to maintain the jaw 111 in the position shown.

FIGS. 4–7 illustrate a method according to the present invention for gripping and torquing a tubular, e.g., in one aspect, a piece of drill pipe, to engage the tubular and then to break a connection between the tubular and another member (e.g., in one aspect, between the tubular and a saver sub of a top drive system). It is within the scope of the present invention to invert the system 110 and use it to make connections.

Figure 4:
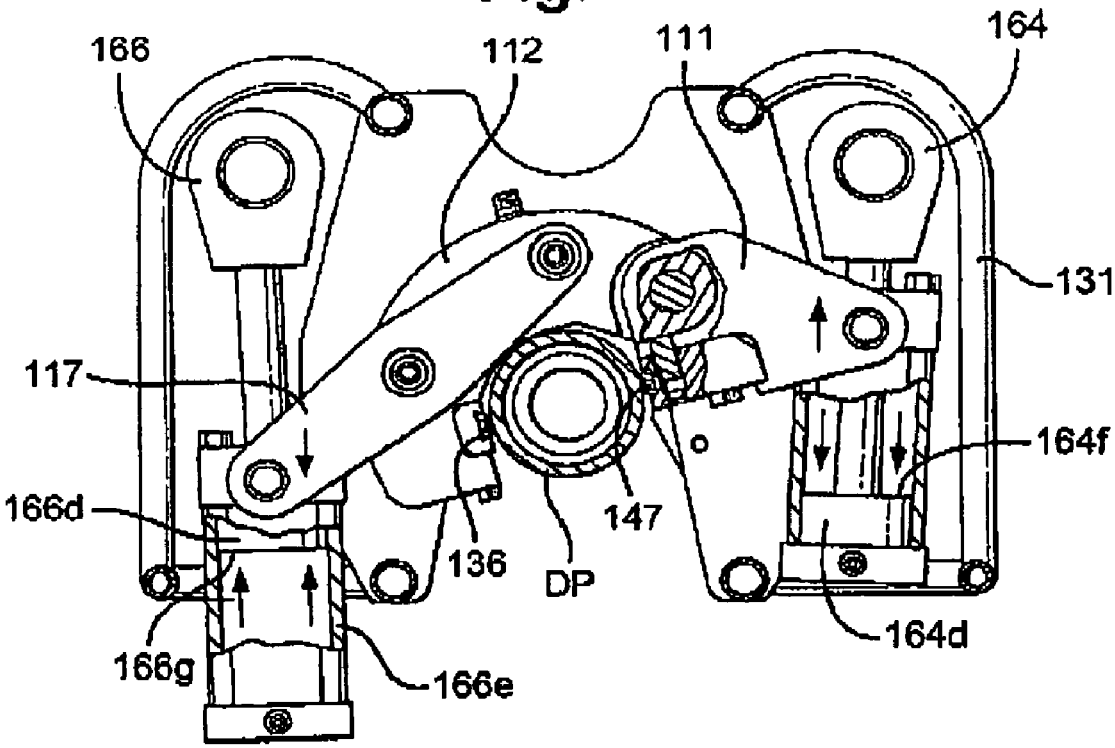
FIGS. 4, 5A, 6, 7, and 8 are top views showing steps in the operation of the gripper shown in FIGS. 2 and 3A.

As shown in FIG. 4 (e.g. when a driller has initiated a method according to the present invention to breaker a saver-sub-drill-pipe connection, e.g. by pressing a button on the driller's console), hydraulic fluid under pressure is applied to a surface 166*g* of the piston 166*d* which moves the housing 166*e* and the components connected to it including the connection bars 117, the jaw 112, and the jaw 111 as shown in FIG. 4 so that the jaws are disposed about a drill pipe DP.

Figure 5A:
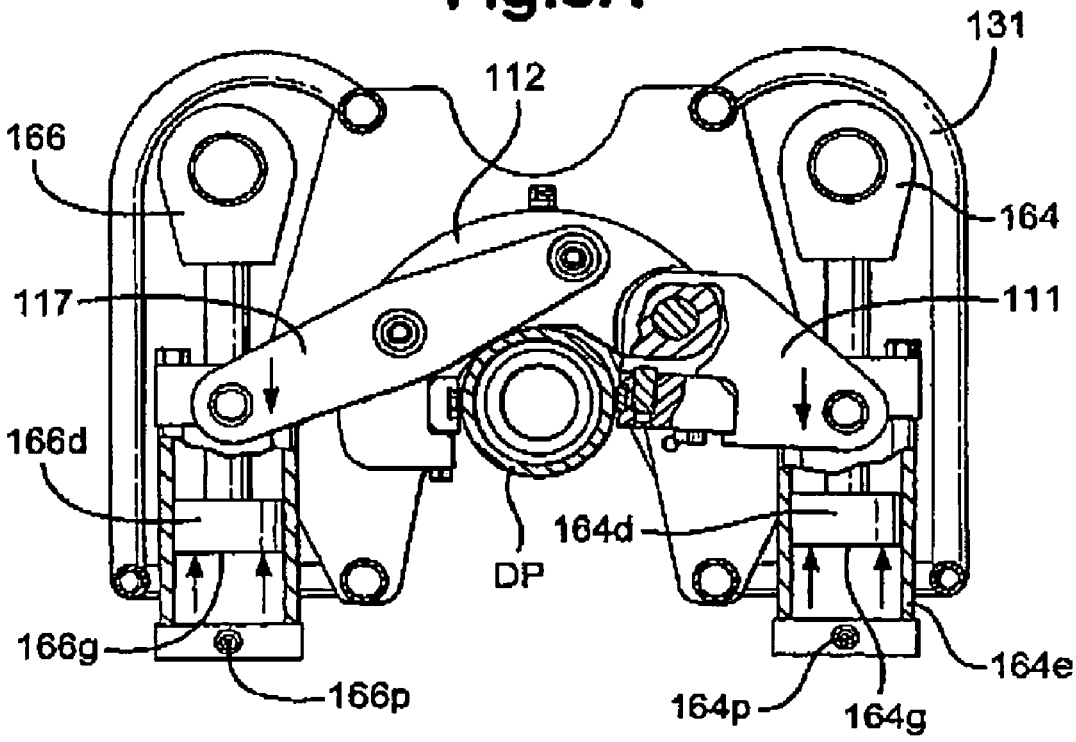
Figure 5B:
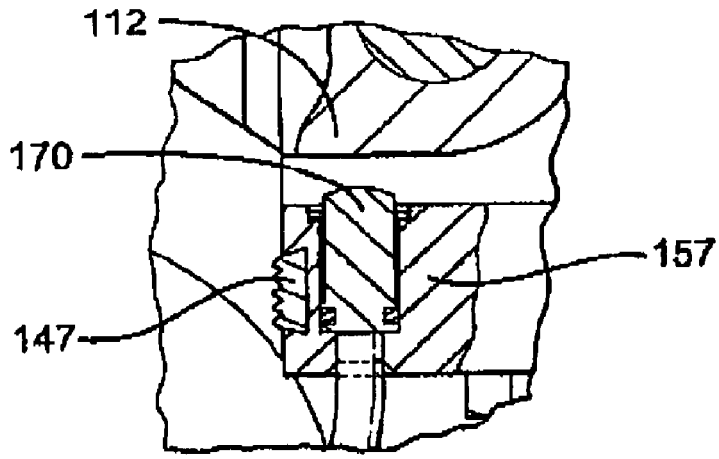
FIG. 5B is an enlargement in cross-section of part of the mechanism of FIG. 5A.

As shown in FIG. 5A, the application of hydraulic fluid under pressure to a surface 164*g* of the piston 164*d* moving the housing 164*e* and the jaw 111 as shown so that the jaws 111, 112 now grip the drill pipe DP as shown in FIG. 5A. As shown in FIG. 5B venting of the fluid from the end 170*a* of the piston 170 allowing the piston 170 to retract within the recess 171 permits the jaw 112 to move with respect to the jaw 111 to the positions shown in FIGS. 5A–6.

Figure 6:
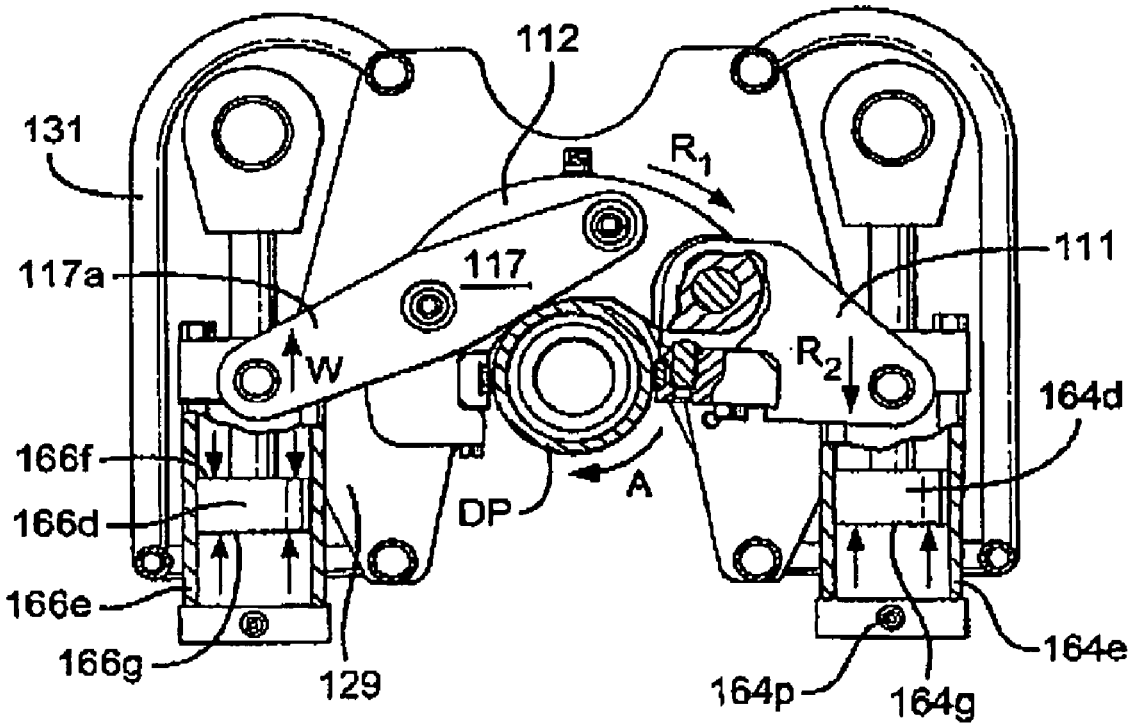
Figure 10:
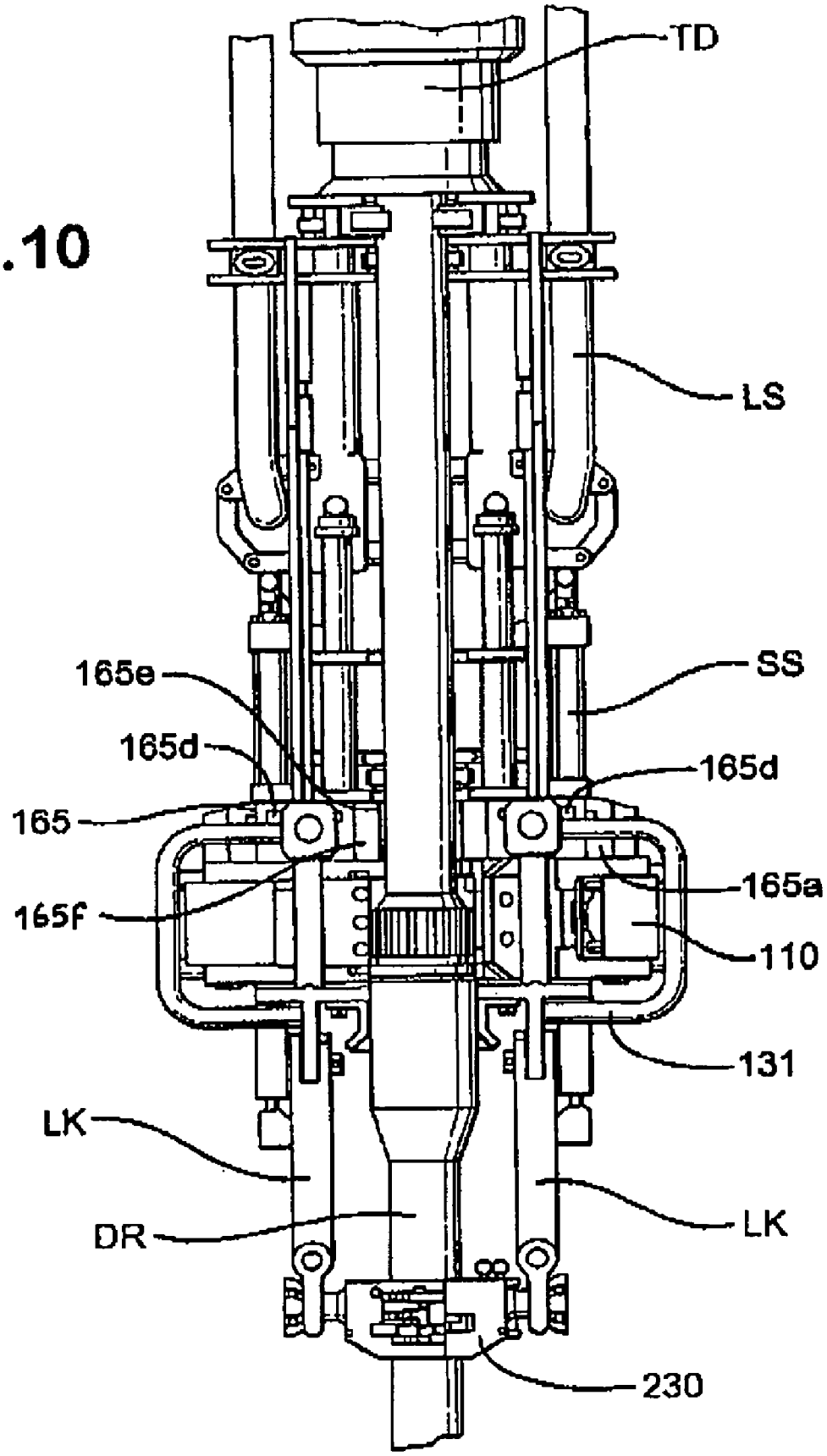
FIG. 10 is a front view, partially cut away, showing a top drive system with a gripper according to the present invention.
Figure 11:
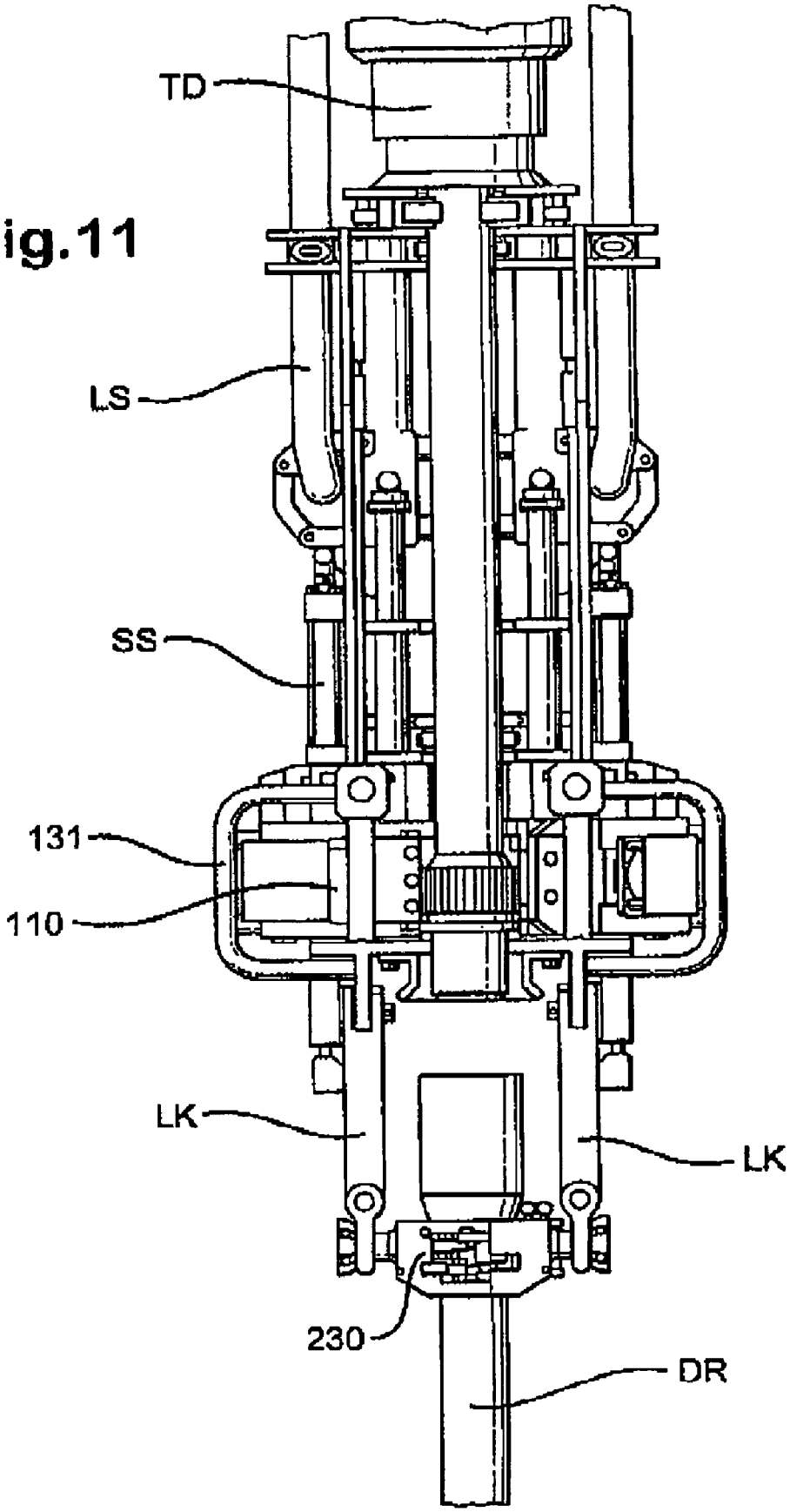
FIG. 11 is a front view of the system of FIG. 10 showing a step in its use.

FIG. 6 illustrates the breaking of a connection, e.g. a connection between the drill pipe DP and a saver sub to which it is connected. Hydraulic fluid under pressure is maintained against the surface 164*g* of the piston 164*d* in the housing 164*e* while hydraulic fluid under pressure is applied against the surface 166*f* of the piston 166*d* within the housing 166*e*. This results in turning of the drill pipe DP in the direction of the arrow A as ends 117*a* of the connection bars 117 move in the direction of the arrow W moving the jaw 112 in the direction of the arrow R1 while the jaw 111 moves in the direction of the arrow R2. The saver sub (not shown in FIG. 6) is held by a splined portion 165*e* of the plate 165*d* (see FIG. 10) so that the saver-sub-drill-pipe connection can be broken. FIGS. 10 and 11 show a top drive TD (partially) with links LS that support a support system SS that supports the gripper system 110 from which are suspended links LK which support the elevator 230 and, in FIG. 11, drill pipe DR.

Figure 7:
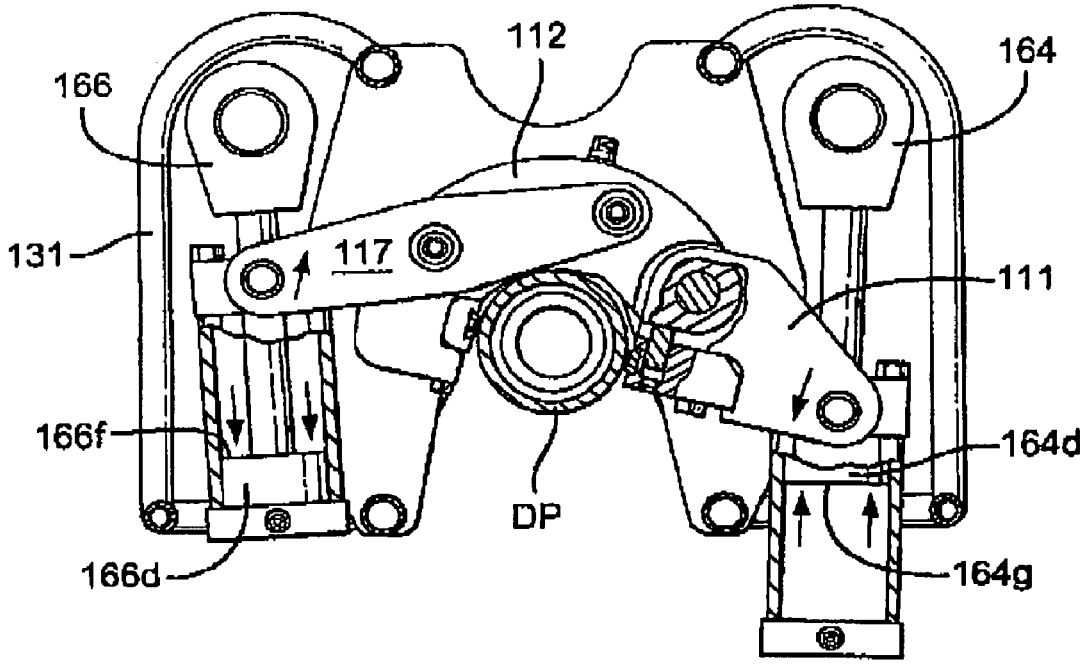

FIG. 7 illustrates the breaking of the connection as the jaws 111 and 112 reach the end limit of their motions as hydraulic fluid under pressure is maintained against the surfaces 166*f* and 164*g* and the pistons 166*d* and 164*d* have reached a limit of their movement within their respective housings 166*e* and 164*e*.

Figure 8:
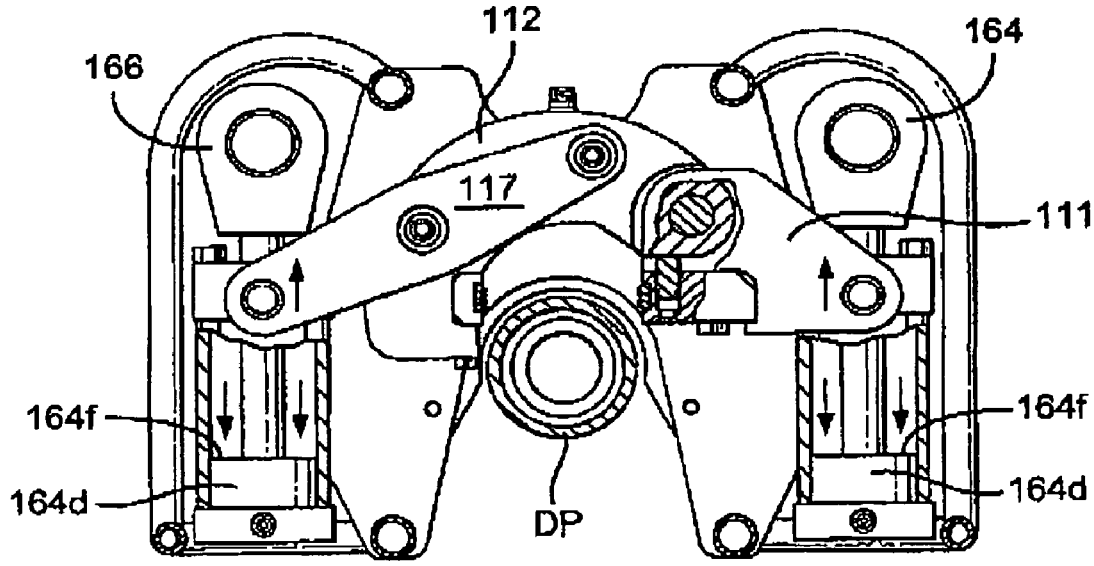

As shown in FIG. 8 the jaws 111, 112 have been moved to their original position or "stored" position (as in FIG. 3A). In this position the piston 170 has returned to its initial position (see FIG. 3B).

Figure 9A:
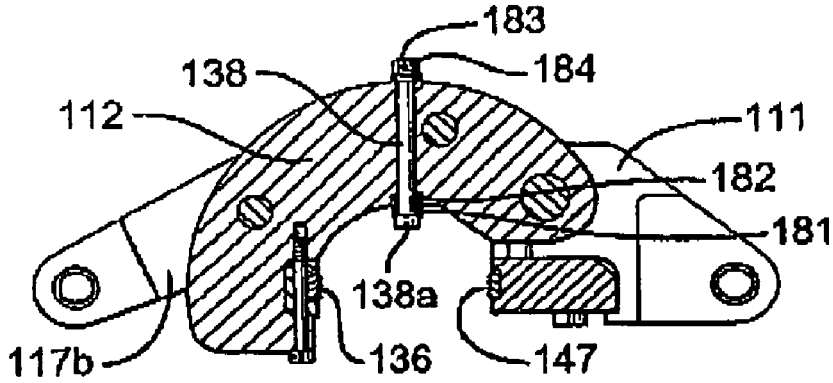
FIGS. 9A–9C are top views of jaws for grippers according to the present invention.
Figure 9B:
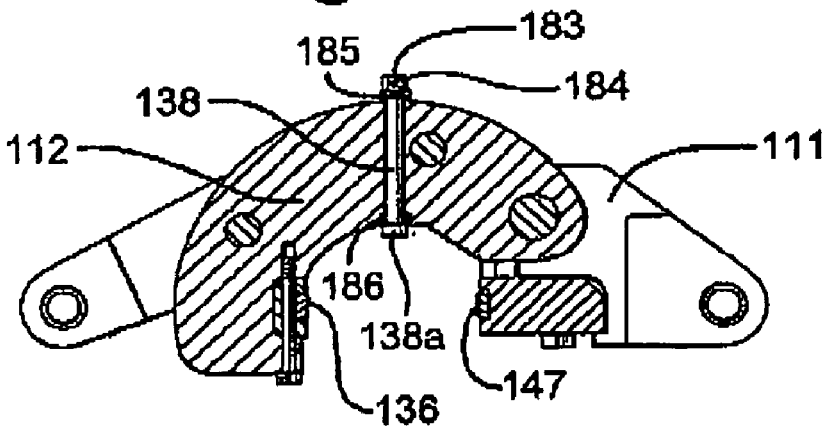
Figure 9C:
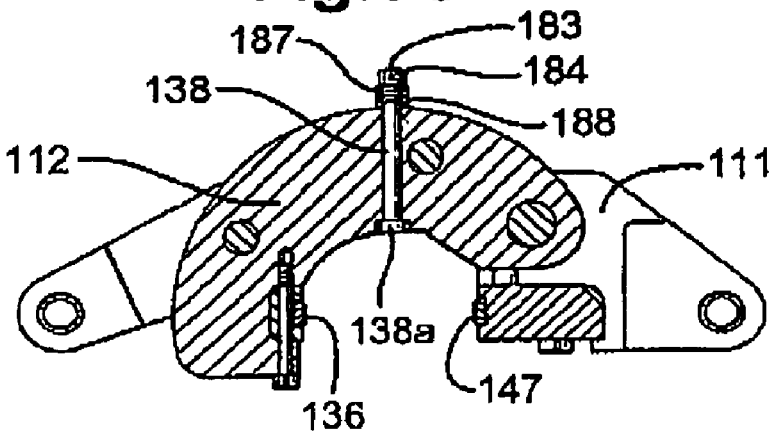

As shown in FIGS. 9A–9C a system according to the present invention (like the system 110 can effectively accommodate tubulars of different diameters. As shown in FIG. 9A by using spacers 181, 182 and a nut 183 and cotter pin 184 with the shoulder screw 138, part 138*a* of the shoulder screw 138 projects inwardly of the jaw 112 to serve as a stop for a tubular (e.g., but not limited to, drill pipe between 3.5 inches and 4 inches in diameter).

FIG. 9B shows the use of spacers 185 and 186 with the shoulder screw 138 so that part 138*a* of he shoulder screw projects inwardly of the jaw 112 to serve as a stop for a tubular (e.g., but not limited to, drill pipe between 4.5 and 5 inches in diameter).

FIG. 9C shows the use of spacers 187 and 187 with the shoulder screw 138 so that part 138*a* of he shoulder screw projects inwardly of the jaw 112 to serve as a stop for a tubular (e.g., but not limited to, drill pipe between 5.5 and 5⅞inches in diameter).

By using the shoulder screw 138 and associated spacers as shown in FIGS. 9A–9C, a tubular is positioned between the jaws 111, 112 so that the inserts 136, 147 are diametrically opposed across the tubular, enhancing efficient gripping of the tubular by the jaws 111, 112. Alternatively and/or in addition to this method of accommodating different size tubulars, jaws with different dimensions may be used.

When a system according to the present invention uses hydraulic power lines for an existing top drive and/or for an existing upper pipe handler, the in-place driller's console, buttons, and controls can be used to control the pipe gripper system according to the present invention. Alternatively a completely separate hydraulic power system and/or controls may be used.

The present invention teaches a pipe gripper in which the same hydraulic piston/cylinder devices are used to clamp a tubular and then used to rotate the same tubular. These devices may be incorporated into known pipe handlers and iron roughnecks.

An extended saver sub may be used with any pipe gripper system according to the present invention, e.g. to bring a connection within a continuous circulation system.

The present invention, therefore, provides in some, but not in necessarily all, embodiments a top drive system with a top drive unit, and a pipe gripping system connected to and beneath the top drive unit, the pipe gripping system having an open throat for receiving a tubular to be gripped by the pipe gripping system.

The present invention, therefore, provides in some, but not in necessarily all, embodiments a top drive system with a top drive unit, and a pipe gripping system connected to and beneath the top drive unit, the pipe gripping system having a body, a first jaw movably connected to the body, a second jaw movably connected to the body, a first piston/cylinder device movably interconnected with the first jaw, a second piston/cylinder device movably interconnected with the second jaw, the first piston/cylinder device for moving the first jaw to clamp a pipe and the second piston/cylinder device for moving the second jaw to clamp the pipe, and both the first piston/cylinder device and the second piston/cylinder device for rotating the pipe.

Such a pipe gripping system may have one or some, in any possible combination, of the following: connectible to and beneath a top drive unit, the pipe gripping system having an open throat for receiving a tubular to be gripped by the pipe gripping system; and/or wherein the pipe gripping system has a body, a first jaw movably connected to the body, a second jaw movably connected to the body, the first jaw connected to the second jaw so that the first jaw and the second jaw move together.

The present invention, therefore, provides in some, but not in necessarily all, embodiments a pipe gripping system which is connectible to and beneath a top drive unit, the pipe gripping system having a body, a first jaw movably connected to the body, a second jaw movably connected to the body, a first piston/cylinder device movably interconnected with the first jaw, a second piston/cylinder device movably interconnected with the second jaw, the first piston/cylinder device for moving the first jaw to clamp a pipe and the second piston/cylinder device for moving the second jaw to clamp the pipe, and both the first piston/cylinder device and the second piston/cylinder device for rotating the pipe. Such a pipe gripping system may have one or some, in any possible combination, of the following: wherein the first jaw is connected to the second jaw so that the first jaw and the second jaw move together; wherein the first piston/cylinder device is disposed for and is operable for pulling the first jaw in a first direction with respect to the pipe to locate the first jaw with respect to the pipe and the first piston/cylinder device is disposed for and operable for then moving the first jaw in a second direction opposite to the first direction for clamping the pipe with the first jaw; wherein the second piston/cylinder device is disposed for and is operable for pulling the first jaw in the second direction with respect to the pipe to locate the second jaw with respect to the pipe and the second piston/cylinder device is disposed for and operable for then moving the second jaw generally in the first direction clamping the pipe with the second jaw; and/or wherein the first piston/cylinder device is disposed for and is, following clamping of the pipe between the first jaw and the second jaw, operable for moving the first jaw generally in the first direction for rotating the pipe for breaking a connection between the pipe and another tubular member, and the second piston/cylinder device is disposed for and is, following clamping of the pipe between the first jaw and the second jaw, operable for moving the second jaw generally in the first direction for rotating the pipe for breaking a connection between the pipe and the another tubular member.

The present invention, therefore, provides in some, but not in necessarily all, embodiments a method for gripping a tubular member beneath a top drive unit, the method including moving a portion of a tubular member into a gripping system, the gripping system located beneath the top drive unit and having an open throat for receiving a tubular to be gripped by the pipe gripping system, the gripping system having a gripping mechanism for gripping the tubular member, the portion of the tubular member moved into the open throat of the gripping system, and gripping the portion of the tubular member with the gripping mechanism of the gripping system.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes.

What is claimed is:

1. A pipe gripping system comprising a body, a first jaw movably connected to the body, a second jaw movably connected to the body, a first piston/cylinder device movably interconnected with the first jaw, a second piston/cylinder device movably interconnected with the second jaw, the first piston/cylinder device for moving the first jaw to clamp a pipe and the second piston/cylinder device for moving the second jaw to clamp the pipe, and the first piston/cylinder device for moving the first jaw and the second piston/cylinder device for moving the second jaw to rotate the pipe.

2. The pipe gripping system of claim 1 wherein the first jaw is connected to the second jaw so that the first jaw and the second jaw move together.

3. The pipe gripping system of claim 2 wherein the first piston/cylinder device is disposed for and is operable for pulling the first jaw in a first direction with respect to the pipe to locate the first jaw with respect to the pipe and the first piston/cylinder device is disposed for and operable for then moving the first jaw in a second direction opposite to the first direction for clamping the pipe with the first jaw.

4. The pipe gripping system of claim 3 wherein the second piston/cylinder device is disposed for and is operable for pulling the second jaw in the second direction with respect to the pipe to locate the second jaw with respect to the pipe and the second piston/cylinder device is disposed for and operable for then moving the second jaw generally in the first direction clamping the pipe with the second jaw.

5. The pipe gripping system of claim 4 wherein the first piston/cylinder device is disposed for and is, following clamping of the pipe between the first jaw and the second jaw, operable for moving the first jaw generally in the first direction for rotating the pipe for breaking a connection between the pipe and another tubular member, and the second piston/cylinder device is disposed for and is, following clamping of the pipe between the first jaw and the second jaw, operable for moving the second jaw generally in the first direction for rotating the pipe for breaking a connection between the pipe and the another tubular member.

6. A pipe gripping system of claim 1 connectable to and beneath a top drive unit.

7. The pipe gripping system of claim 6, the body having an open throat for receiving a tubular to be gripped by the pipe gripping system.

8. The pipe gripping system of claim 1, the body having an open throat for receiving a tubular to be gripped by the pipe gripping system.

9. A top drive system comprising a top drive unit, and a pipe gripping system connected to and beneath the top drive unit, the pipe gripping system having a body, a first jaw movably connected to the body, a second jaw movably connected to the body, a first piston/cylinder device movably interconnected with the first jaw, a second piston/cylinder device movably interconnected with the second jaw, the first piston/cylinder device for moving the first jaw to clamp a pipe and the second piston/cylinder device for moving the second jaw to clamp the pipe, and both the first piston/cylinder device and the second piston/cylinder device for rotating the pipe.

10. A method for gripping a tubular member beneath a top drive unit, the method comprising moving a portion of a tubular member into a gripping system, the gripping system located beneath the top drive unit and having an open throat for receiving a tubular to be gripped by the pipe gripping system, the gripping system comprising a body, a first jaw movably connected to the body, a second jaw movably connected to the body, a first piston/cylinder device movably interconnected with the first jaw, a second piston/cylinder device movably interconnected with the second jaw, the first piston/cylinder device for moving the first jaw to clamp a pipe and the second piston/cylinder device for moving the second jaw to clamp the pipe, and the first piston/cylinder device for moving the first jaw and the second piston/cylinder device for moving the second jaw to rotate the pipe, and gripping the portion of the tubular member with the gripping mechanism of the gripping system.

* * * * *